US009966715B2

(12) United States Patent
Ishibashi

(10) Patent No.: US 9,966,715 B2
(45) Date of Patent: May 8, 2018

(54) DEVICE CONNECTOR

(71) Applicant: Sumitomo Wiring Systems, Ltd., Yokkaichi-shi, Mie (JP)

(72) Inventor: Takeshi Ishibashi, Yokkaichi (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days. days.

(21) Appl. No.: 15/545,733

(22) PCT Filed: Jan. 15, 2016

(86) PCT No.: PCT/JP2016/051087
§ 371 (c)(1),
(2) Date: Jul. 24, 2017

(87) PCT Pub. No.: WO2016/121525
PCT Pub. Date: Aug. 4, 2016

(65) Prior Publication Data

US 2018/0019557 A1 Jan. 18, 2018

(30) Foreign Application Priority Data

Jan. 28, 2015 (JP) ..... 2015-014046

(51) Int. Cl.
*H01R 27/02* (2006.01)
*H01R 13/424* (2006.01)
*H01R 13/512* (2006.01)

(52) U.S. Cl.
CPC ..... *H01R 27/02* (2013.01); *H01R 13/424* (2013.01); *H01R 13/512* (2013.01)

(58) Field of Classification Search
CPC ..... H01R 27/02; H01R 13/424; H01R 13/512
(Continued)

(56) References Cited

U.S. PATENT DOCUMENTS 9,318,849 B2 * 4/2016 Kobayashi ..... H01R 13/5205
9,455,525 B2 * 9/2016 Uno ..... H01R 11/12
(Continued)

FOREIGN PATENT DOCUMENTS

EP 2 808 950 12/2014
JP 2011-34935 2/2011
(Continued)

OTHER PUBLICATIONS

International Search Report dated Mar. 29, 2016.
Japanese Office Action and Translation dated Feb. 13, 2018.

*Primary Examiner* — Alexander Gilman
(74) *Attorney, Agent, or Firm* — Gerald E. Hespos; Michael J. Porco; Matthew T. Hespos

(57) ABSTRACT

A device connector includes: a terminal metal fitting 70 including a first connecting portion 71, a second connecting portion 72, and a flexible conductive member 73 linking the connecting portions 71, 72; a housing 80 having a cavity 81 for accommodating the first connecting portion 71; and a guide member 90 attached to a rear surface of the housing 80, and having an insertion hole 93 opened concentrically with the cavity 81, the insertion hole 93 corresponding to a connecting end of the flexible conductive member 73 of the terminal metal fitting 70 to be connected to the first connecting portion 71. The flexible conductive member 73 has a connecting end to be connected to the second connecting portion 72 extending outside the guide member 90 through the insertion hole 93.

7 Claims, 13 Drawing Sheets

(58) Field of Classification Search
USPC ..... 439/651
See application file for complete search history.

(56) References Cited

U.S. PATENT DOCUMENTS

| | | | | |
|---|---|---|---|---|
| 9,531,100 | B2 * | 12/2016 | Fukushima | H01R 13/08 |
| 2004/0214464 | A1 * | 10/2004 | Fukushima | H01R 13/5219 439/271 |
| 2011/0316372 | A1 * | 12/2011 | Kobayashi | H01R 9/24 310/71 |
| 2011/0316373 | A1 * | 12/2011 | Kobayashi | H01R 9/24 310/71 |
| 2012/0015546 | A1 * | 1/2012 | Yamaguchi | H01R 13/05 439/370 |
| 2012/0142214 | A1 * | 6/2012 | Kawamura | H01R 4/34 439/571 |
| 2012/0149240 | A1 * | 6/2012 | Ishibashi | H01R 13/4223 439/595 |
| 2012/0319513 | A1 * | 12/2012 | Okamoto | H01R 13/5202 310/71 |
| 2013/0017719 | A1 * | 1/2013 | Tanaka | H01R 9/032 439/587 |
| 2013/0056256 | A1 * | 3/2013 | Guillanton | H01R 9/0503 174/359 |
| 2013/0065436 | A1 * | 3/2013 | Hirabayashi | H01R 13/113 439/595 |
| 2013/0260585 | A1 * | 10/2013 | Wang | H01R 13/5202 439/271 |
| 2014/0008122 | A1 * | 1/2014 | Imahori | H01B 17/308 174/77 R |
| 2014/0011401 | A1 * | 1/2014 | Endo | H01R 13/5205 439/588 |
| 2014/0038459 | A1 * | 2/2014 | Kobayashi | H01R 9/032 439/607.41 |
| 2014/0106588 | A1 * | 4/2014 | Suzuki | H01R 13/5219 439/271 |
| 2014/0179161 | A1 * | 6/2014 | Imahori | H01R 13/6592 439/607.45 |
| 2014/0209377 | A1 * | 7/2014 | Wang | H02G 3/22 174/658 |
| 2014/0235104 | A1 * | 8/2014 | Wang | H01R 13/648 439/607.41 |
| 2015/0340790 | A1 * | 11/2015 | Hamai | H01R 13/4223 439/660 |

FOREIGN PATENT DOCUMENTS

| | | |
|---|---|---|
| JP | 2013-101856 | 5/2013 |
| JP | 2014-13675 | 1/2014 |
| JP | 2014-225334 | 12/2014 |
| JP | 2014-232688 | 12/2014 |
| WO | 2010/110032 | 9/2010 |
| WO | 2011/055806 | 5/2011 |
| WO | 2011/108726 | 9/2011 |

* cited by examiner

DEVICE CONNECTOR

BACKGROUND

1. Field of the Invention

The present invention relates to a device connector attached to a device case for application.

2. Description of the Related Art

A device for electrically connecting a motor and an inverter in electric vehicles and hybrid vehicles has been proposed. In the device, a motor-side housing including a motor-side terminal mounted to a motor case, and an inverter-side housing including an inverter-side terminal mounted to an inverter case are disposed opposing each other. The housings are fitted to each other by connecting the inverter case directly to the motor case, whereby the terminals are connected (see, for example, Japanese Unexamined Patent Publication No. 2011-34935).

In the device, on the inverter side, for example, a connecting portion on the side being led rearward from the inverter-side housing of the inverter-side terminal is configured to be connected to an inverter output terminal using a screw, using a terminal base provided in the inverter case. In this case, a positional displacement may exist between the inverter-side housing and the terminal base. Accordingly, in the device, a braided wire is interposed at a midway position of the inverter-side terminal so as to absorb the positional displacement, utilizing the flexibility of the braided wire.

In the conventional example, the inverter-side terminal has the structure in which a flexible braided wire is interposed. When the inverter-side housing is attached to the inverter case, for example, the inverter-side terminal may interfere with other members. As a result, the posture of the braided wire on the side being bent and led rearward from the inverter-side housing may be displaced, making the operation for connection with the inverter output terminal on the terminal base using a screw difficult.

The present invention was made in view of the above circumstances. An object of the present invention is to reduce or prevent unnecessary deformation of a terminal metal fitting.

SUMMARY

A device connector according to the present invention includes a terminal metal fitting including a first connecting portion, a second connecting portion, and a flexible conductive member linking the first connecting portion and the second connecting portion; a housing having a cavity for accommodating the first connecting portion; and a guide member attached to a rear surface of the housing, and having an insertion hole opened concentrically with the cavity, the insertion hole corresponding to a connecting end of the flexible conductive member of the terminal metal fitting, the connecting end being to be connected to the first connecting portion. The flexible conductive member has a connecting end to be connected to the second connecting portion extending outside the guide member through the insertion hole.

According to the above configuration, the outer periphery of the connecting end of the flexible conductive member to be connected to the first connecting portion is fitted in the insertion hole of the guide member and held thereby. As a result, unnecessary deformation of the flexible conductive member is reduced or prevented. In addition, displacement of the second connecting portion of the terminal metal fitting is reduced or prevented.

The following configurations may also be adopted.

(1) The housing may have a plurality of terminal metal fittings attached thereto side by side, and the insertion hole of the guide member may be formed with a relief surface for avoiding interference with an eccentrically bent portion of the flexible conductive member extending through the insertion hole.

When a plurality of terminal metal fittings are disposed side by side, the first connecting portion side accommodated in the housing and the second connecting portion side disposed outside the housing may have different parallel-pitch settings. In this case, the parallel-pitch of the second connecting portion side may be modified by bending the flexible conductive member of a predetermined terminal metal fitting toward the relief surface side in the insertion hole of the guide member, while eccentrically extending the second connecting portion side.

(2) The device connector may include a lock plate configured to attach the housing to a device for attachment, the lock plate having a lock hole opened so as to be lockable on a peripheral edge of a flange circumferentially disposed on an outer surface of the housing. The device connector may be configured as a sub-assembly with the lock plate retained between the flange and the guide member attached on the rear surface of the housing.

With the flange of the housing sandwiched between the lock plate and the device, the housing is mounted to the device. In this case, from the state in which the lock plate is fitted to the housing in advance and received on the flange, the guide member is attached to the rear surface of the housing. In this way, the device connector is assembled in the form of a sub-assembly with the lock plate being sandwiched between the guide member and the flange. The sub-assembly is delivered, and the housing is mounted to the device using the lock plate as described above. In the sub-assembly state, the guide member functions as a lock plate retainer, whereby the lock plate is prevented from falling off during delivery of the sub-assembly.

(3) The guide member may be formed by assembling a pair of divided guide members.

The guide member may be integrated later without being passed through the terminal metal fitting in advance. Accordingly, the connector assembly operation is simplified.

According to the present invention, unnecessary deformation of a terminal metal fitting can be reduced or prevented.

DETAILED DESCRIPTION

An embodiment of the present invention will be described with reference to FIG. 1 to FIG. 13.

Figure 5:
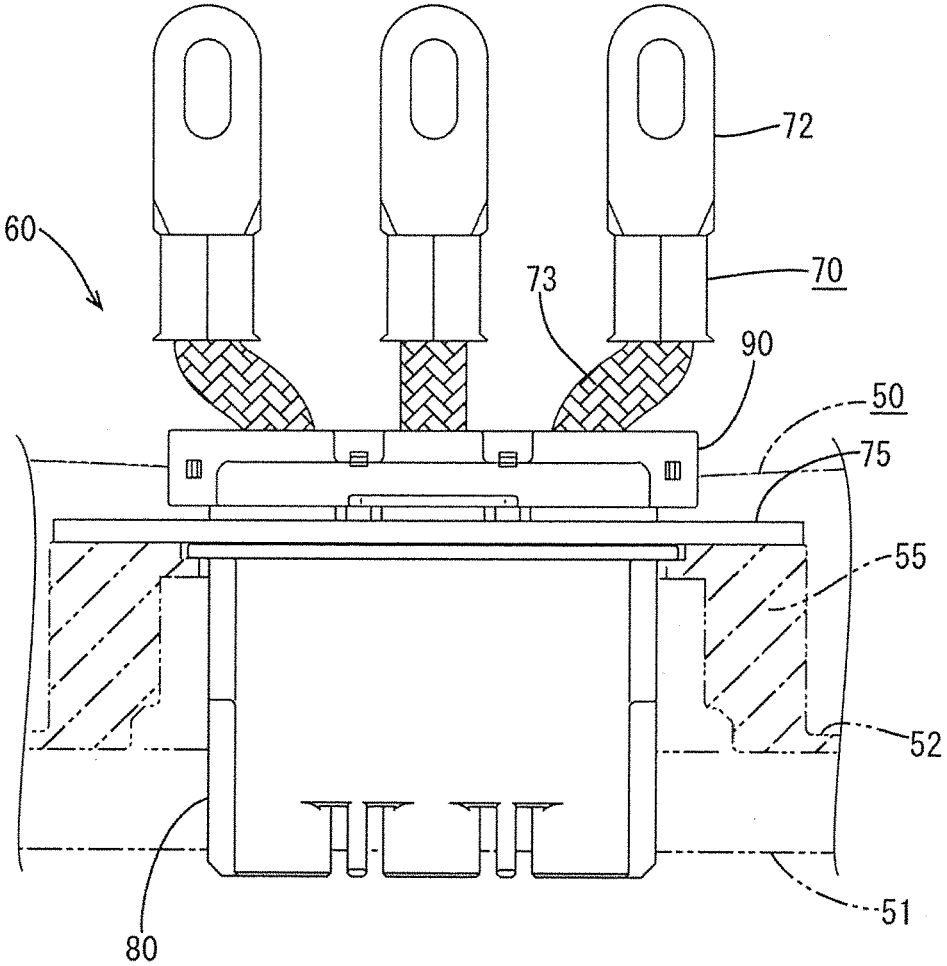
FIG. 5 is a plan view of the motor-side connector and the inverter-side connector prior to being fitted together.
Figure 5:
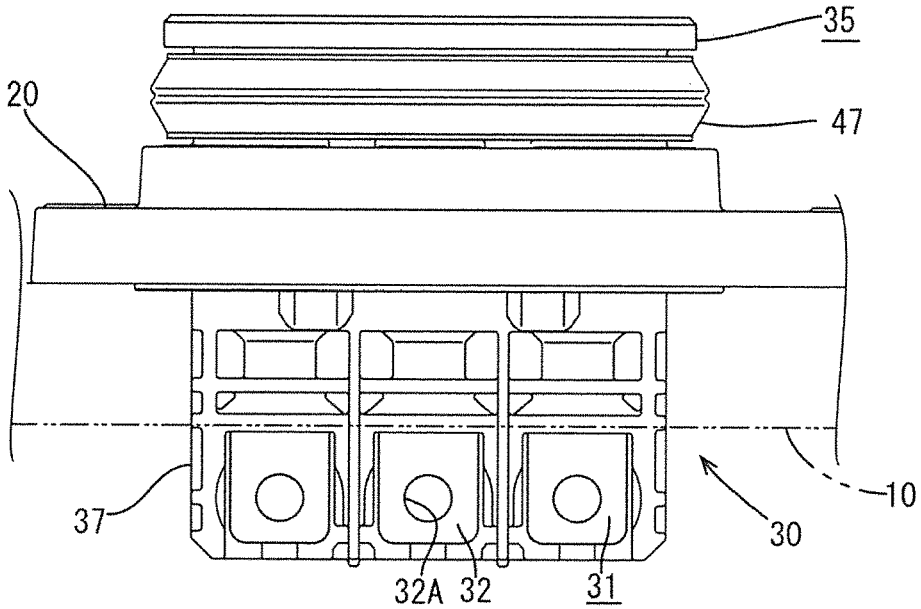
Figure 6:
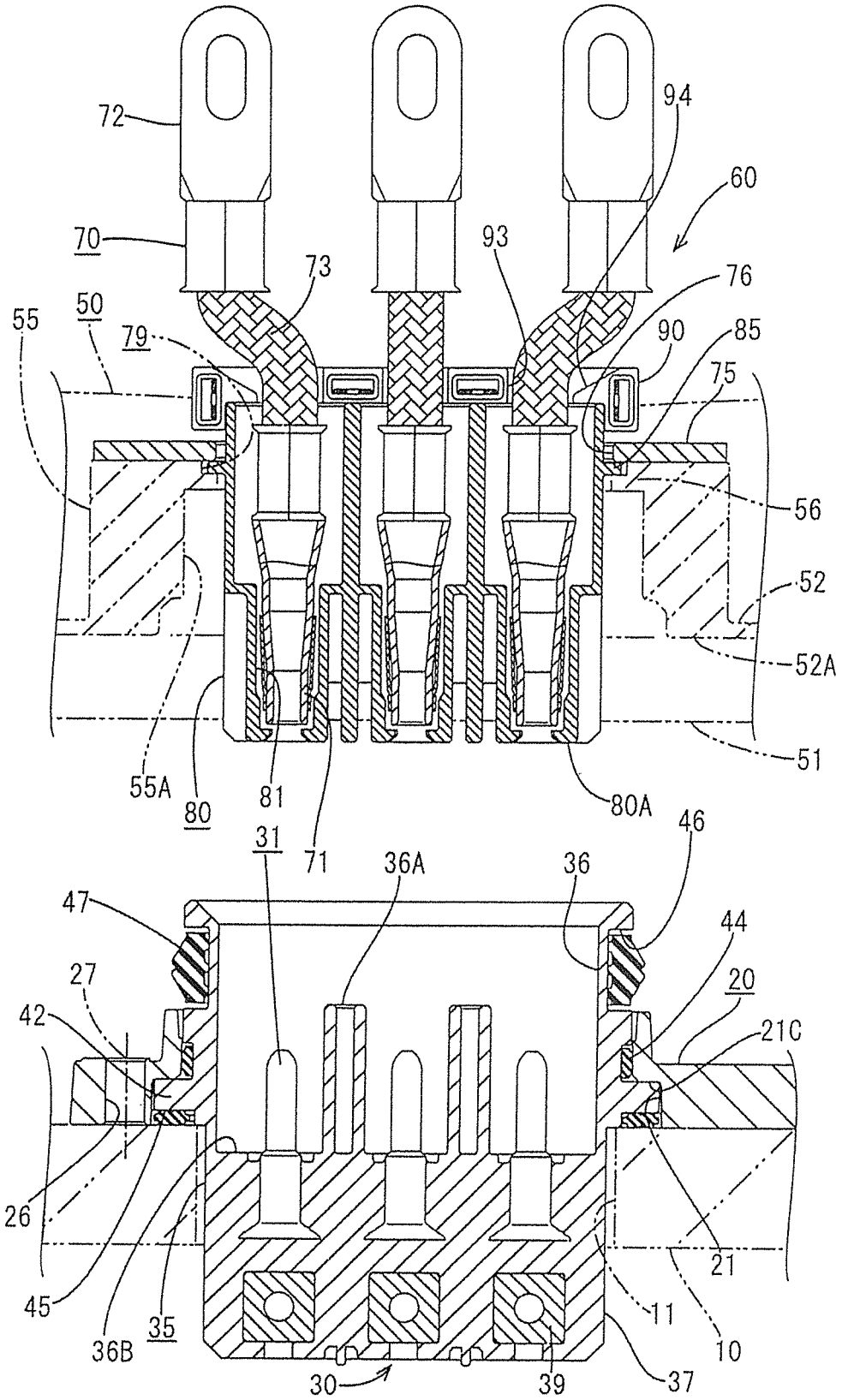
FIG. 6 is a front cross sectional view of the motor-side connector and the inverter-side connector (cross sectional view taken along line VI-VI of FIG. 3 and FIG. 4).
Figure 7:
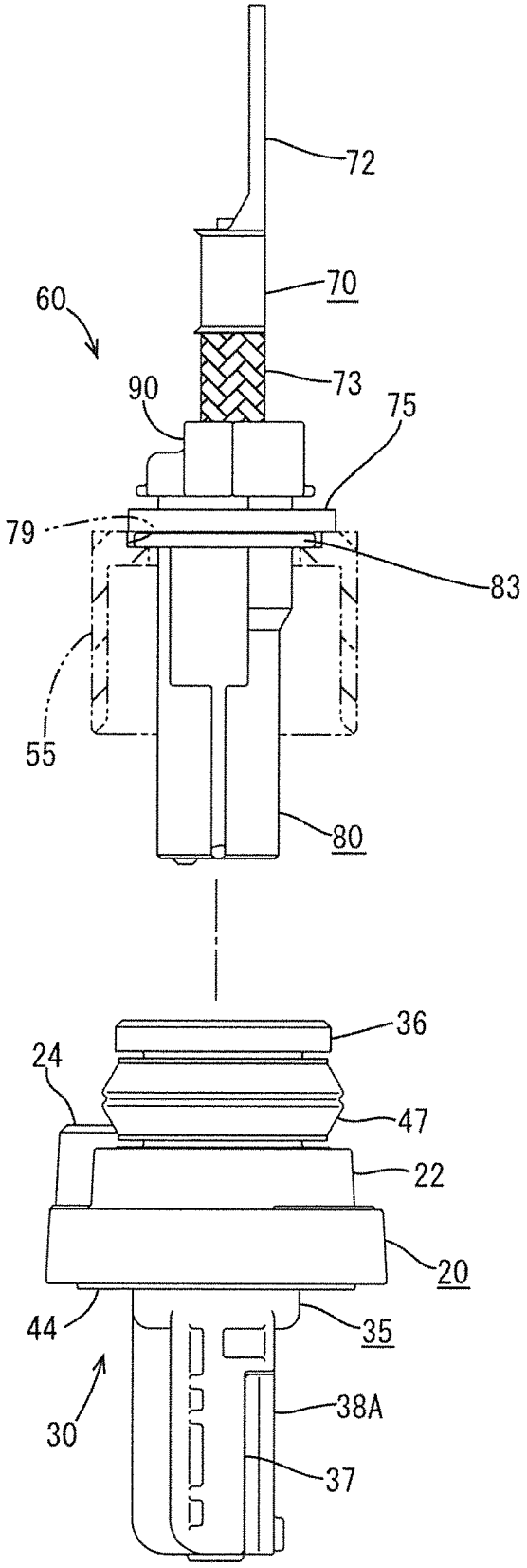
FIG. 7 is a side view of the motor-side connector and the inverter-side connector.

In the present embodiment, as illustrated in FIG. 5 and FIG. 6, a motor-side connector 30 is attached to a motor case 10 constituting a motor that is a counterpart device of the present invention. An inverter-side connector 60 is attached to an inverter case 50 constituting an inverter PCU (hereafter simply referred to as the inverter) that is a device according to the present invention. The motor-side connector 30 and the inverter-side connector 60 are disposed vertically opposing each other. When the inverter case 50 is mounted on the motor case 10 and coupled therewith, the motor-side connector 30 and the inverter-side connector 60 are fitted to each other.

The motor-side connector 30 and the inverter-side connector 60 are both three-pole connectors. The inverter-side connector 60 corresponds to the device connector according to the present invention.

Figure 1:
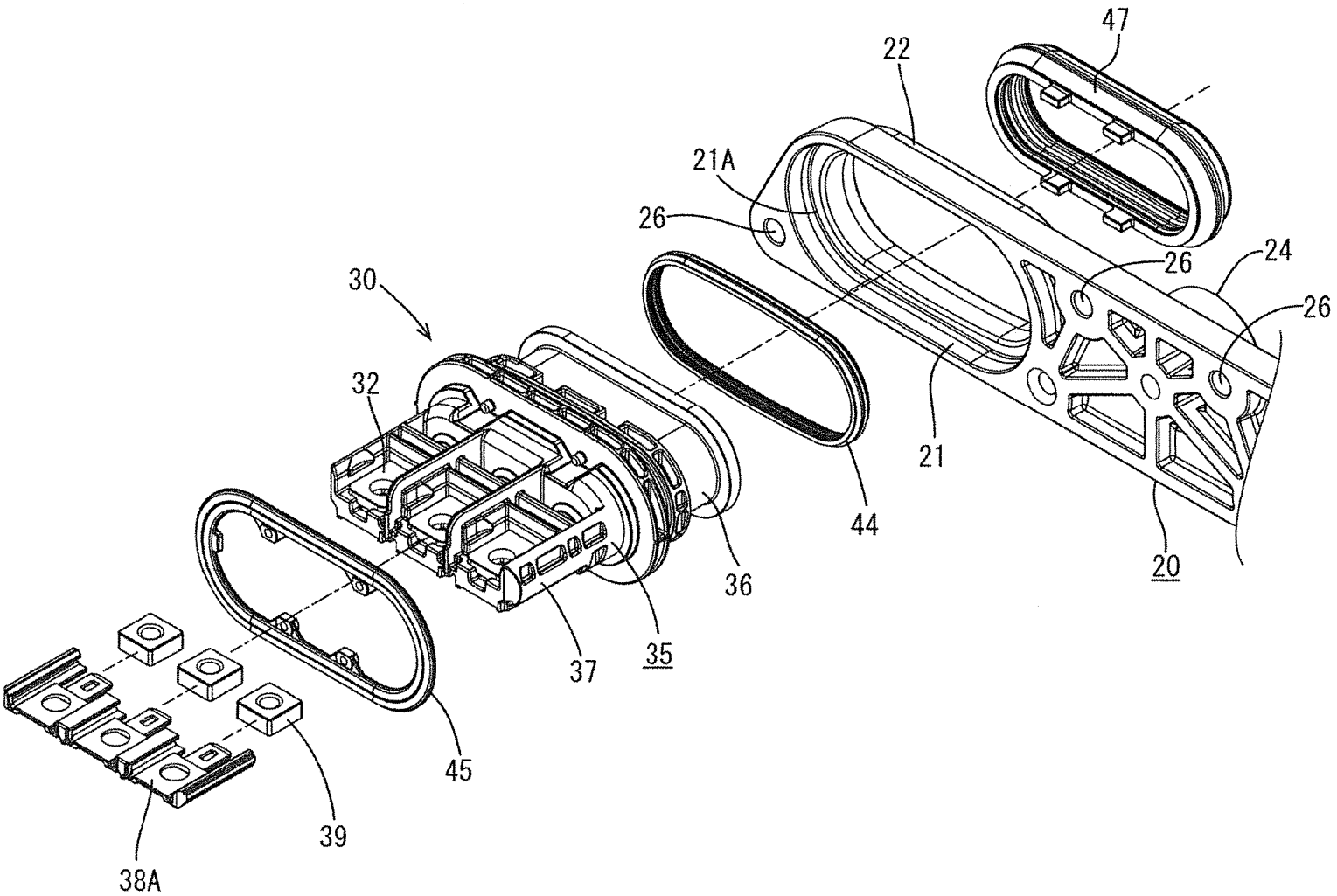
FIG. 1 is an exploded perspective view of a motor-side connector according to an embodiment of the present invention.
Figure 8:
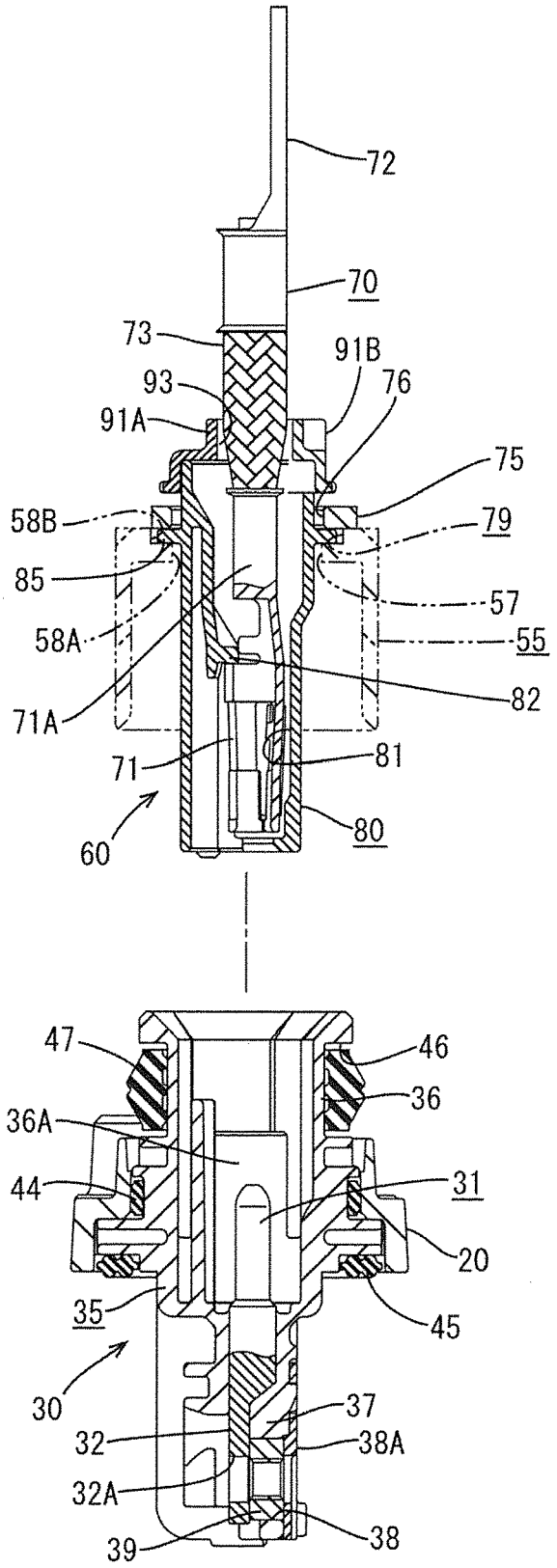
FIG. 8 is a lateral cross sectional view of the motor-side connector and the inverter-side connector (cross sectional view taken along line VIII-VIII of FIG. 3 and FIG. 4).
Figure 10:
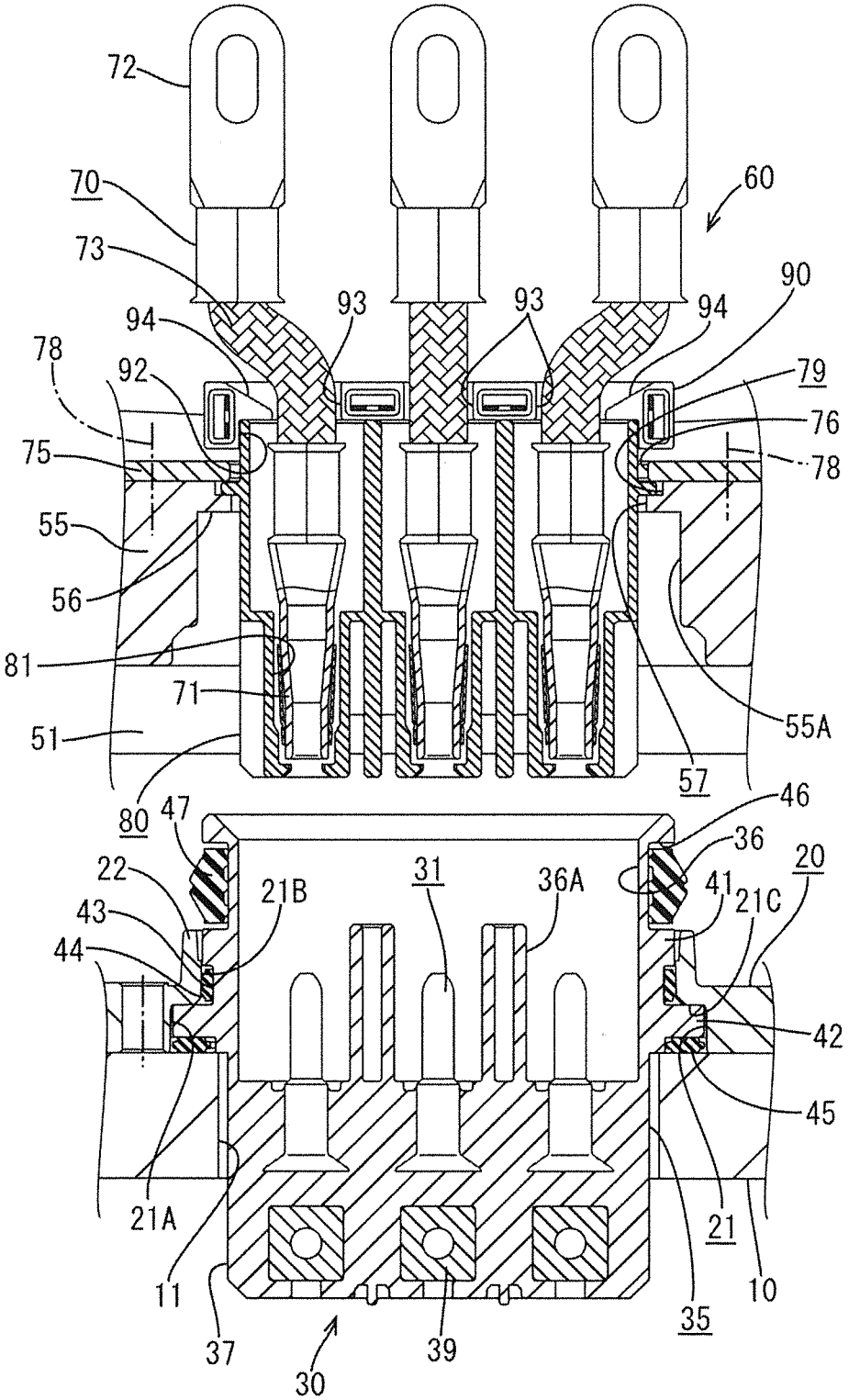
FIG. 10 is a partial cross sectional view illustrating a state immediately before the start of fitting of the motor-side connector with the inverter-side connector in a fitting step.

The counterpart device on the motor side will be described. As illustrated in FIG. 1, FIG. 8, and FIG. 10, the motor-side connector 30 includes three motor-side terminals 31 embedded and attached in a synthetic resin male housing 35 by insert molding. The motor-side terminals 31 are male terminals including round pins. At lower ends of the motor-side terminals 31, connecting plate portions 32 having connecting holes 32A are formed.

The male housing 35 includes a shape in which a terminal base 37 is continuously provided on a lower surface side of an oval cylindrical hood portion 36 with an upper surface opening. In the hood portion 36, two partitioning walls 36A are formed upright on the bottom surface.

With respect to the male housing 35, the three motor-side terminals 31 are embedded side by side. The ends of the motor-side terminals 31 respectively protrude into three regions in the hood portion 36 partitioned by the partitioning walls 36A. The connecting plate portions 32 of the motor-side terminals 31 are disposed side by side and exposed in a lower end portion of the terminal base 37.

In the back surface side of the connecting plate portions 32 of the terminal base 37, nut accommodating holes 38 are respectively formed. In the nut accommodating holes 38, rectangular nuts 39 are accommodated so as to be prevented from turning, and retained by holders 38A attached to the back surface.

Figure 3:
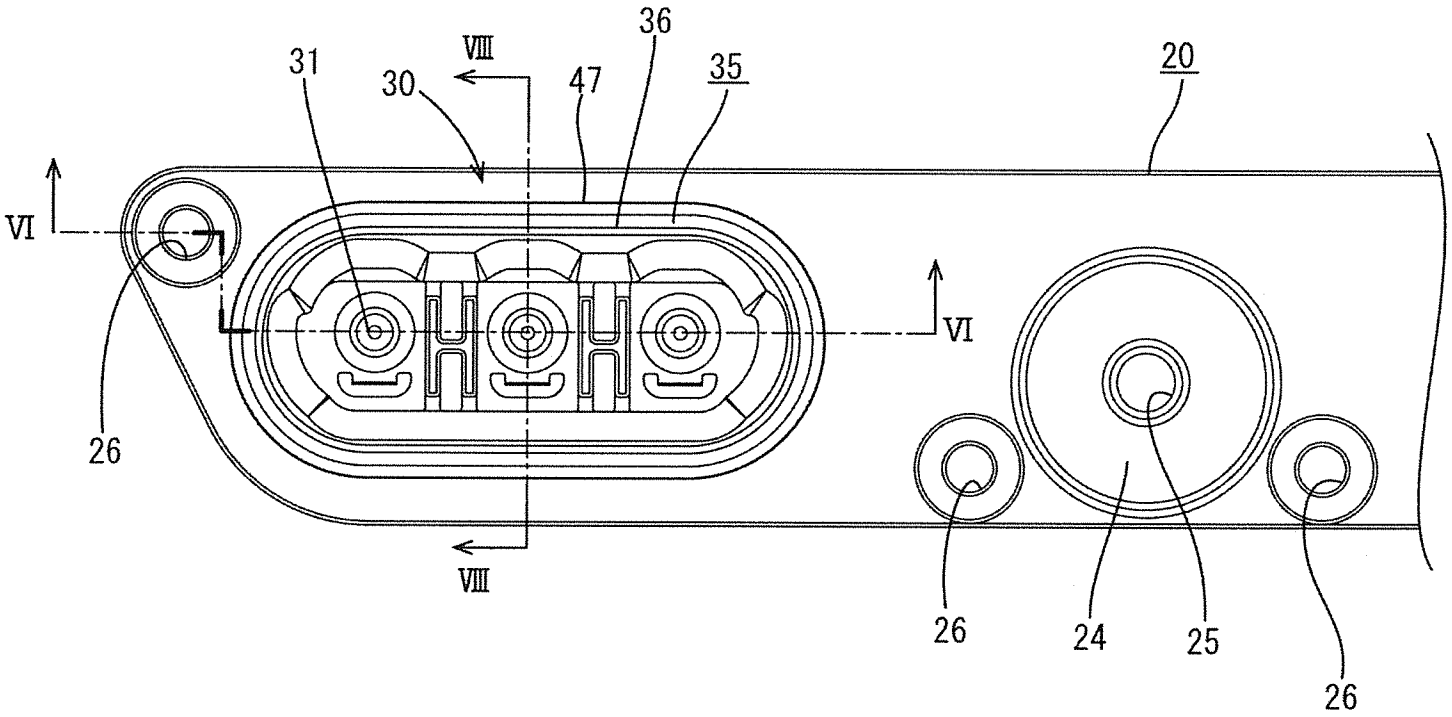
FIG. 3 is a plan view illustrating a motor-side connector attachment structure.

As illustrated in FIG. 3 and FIG. 6, the motor-side connector 30 is adapted to be attached to the motor case 10 so as to be retained in a predetermined position of the shield shell 20.

Accordingly, as illustrated in FIG. 10, on an outer periphery of a lower end portion of the hood portion 36 of the male housing 35, a small-diameter upper flange 41 and a large-diameter lower flange 42 are formed at a predetermined interval. A groove portion 43 is configured between an inner periphery side of the lower flange 42 and the upper flange 41, and adapted to be fitted with a second axial seal 44.

The shield shell 20 is made of die-cast aluminum and, as illustrated in FIG. 1, formed in the shape of a thick strip. The shield shell 20 has a holding hole 21 into which the motor-side connector 30 can be fitted from below.

As illustrated in FIG. 10, the holding hole 21 is a stepped hole including, on a lower end side, a large-diameter hole 21A in which the lower flange 42 formed on the male housing 35 is substantially tightly fitted, and, on an upper end side, a small-diameter hole 21B in which the upper flange 41 is substantially tightly fitted. On a hole edge of an upper surface of the small-diameter hole 21B, a peripheral wall 22 is formed upright so as to be substantially flush with an inner surface of the small-diameter hole 21B. The large-diameter hole 21A has a depth (height) greater than a thickness of the upper flange 41.

The motor-side connector 30 is fitted into the holding hole 21 of the shield shell 20 from below until the lower flange 42 is abutted on the step portion 21C of the holding hole 21 when the upper flange 41 has entered an upper end portion of peripheral wall 22, with the upper end portion of the male housing 35 protruding above the peripheral wall 22. The gap between the outer periphery of the male housing 35 and the inner periphery of the holding hole 21 is sealed by the second axial seal 44.

On a lower surface of the lower flange 42, a surface seal 45 is attached. The surface seal 45 is pressed onto an outer periphery of a hole edge on the upper surface of an mounting hole 11, as will be described below, opened in the motor case 10, to seal the mounting hole 11. In an outer periphery of an end portion of the male housing 35, an attachment groove 46 is circumferentially provided. In the attachment groove 46, a first axial seal 47 is attached to seal a gap from an inner peripheral surface of a fitting recess portion 55A, as will be described below, opened in the inverter case 50.

As illustrated in FIG. 1 and FIG. 3, a female screw base 24 is formed so as to protrude laterally of the holding hole 21 of the shield shell 20. At the center of the female screw base 24, a screw hole 25 is formed for threaded engagement of a fastening bolt 100, as will be described below, attached to the inverter case 50 side.

At the end of the shield shell 20 and on both sides of the female screw base 24, bolt insertion holes 26 are opened.

As illustrated in FIG. 6, in an upper surface of the motor case 10, two mounting holes 11 are opened at the same pitch as that of the holding holes 21 of the shield shell 20. In each of the mounting holes 11, the lower side of the male housing 35 protruding downward from each of the holding holes 21 is substantially tightly fitted.

The shield shell 20 is adapted to be stacked on the upper surface of the motor case 10 with the lower side of the male housing 35 fitted in the corresponding mounting hole 11, and fixed when the bolts 27 are inserted into the bolt insertion holes 26 and screwed into screw holes (not illustrated) formed in the motor case 10. The terminal bases 37 of the male housings 35 protrude into the motor case 10.

Specifically, the motor-side connectors 30 are adapted to be fixedly attached via the shield shell 20 while penetrating through the mounting holes 11 opened in the upper surface of the motor case 10.

The device according to the present invention on the inverter side will be described.

Figure 2:
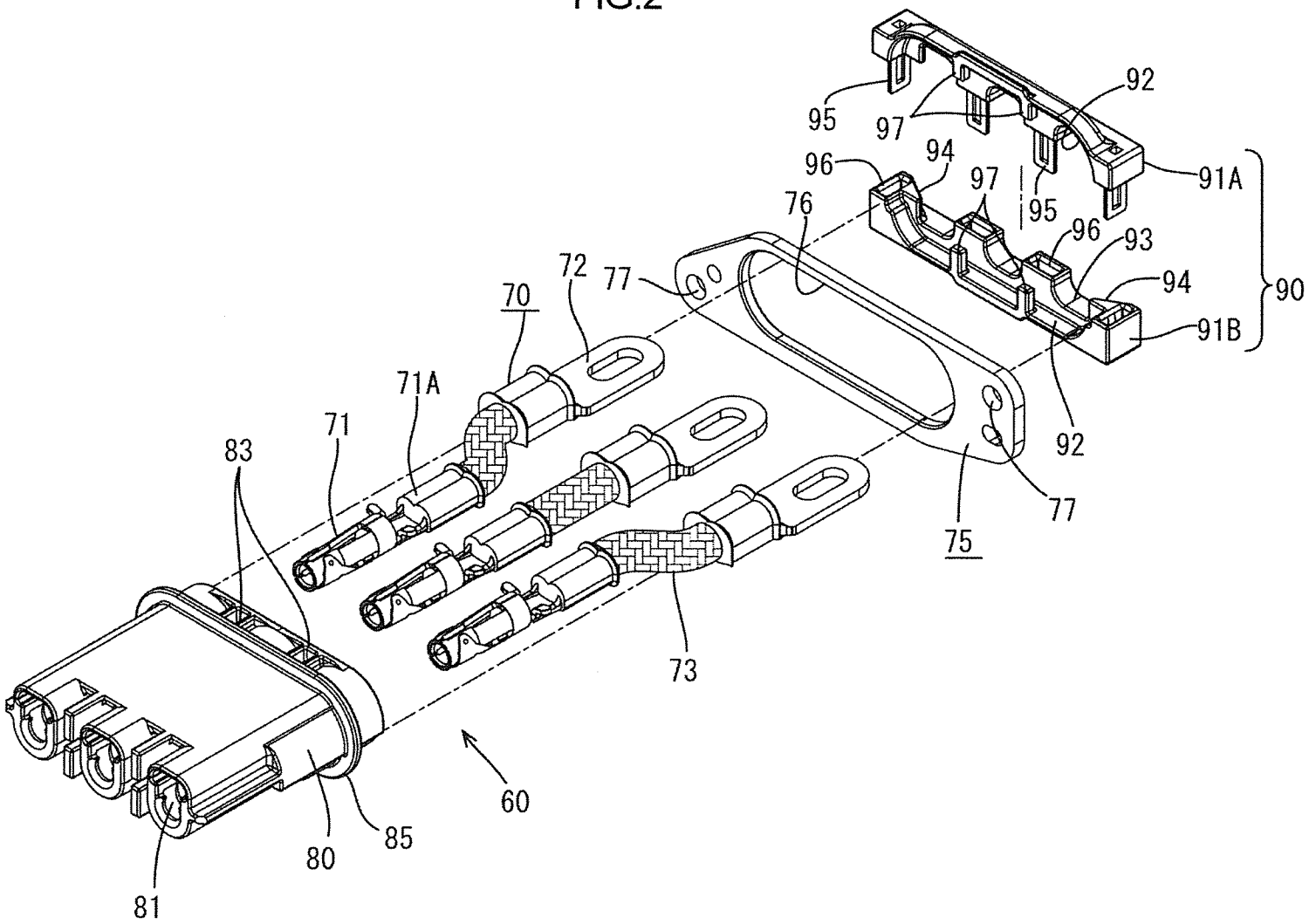
FIG. 2 is an exploded perspective view of an inverter-side connector.

As illustrated in FIG. 2, FIG. 6, and FIG. 8, the inverter-side connector 60 is provided with a synthetic resin female housing 80, three inverter-side terminals 70 attached to the female housing 80, and a guide member 90 (which also has an end retainer function) attached to the rear end of the female housing 80. The inverter-side terminals 70 include female terminals 71 which are connected to the motor-side terminals 31, BA terminals 72 which are connected to inverter output terminals (not illustrated), and braided wires 73 linking the terminals 71, 72.

The female housing 80 is formed in a block shape having an oval outline enabling fitting in the male housing 35 of the motor-side connector 30. In the female housing 80, three cavities 81 for accommodating the female terminals 71 of the inverter-side terminals 70 are formed side by side.

The guide member 90 is also made of synthetic resin and, as illustrated in FIG. 2, formed by assembling a pair of divided guide members 91A, 91B. The integrally assembled guide member 90 is formed in the shape of a laterally long and rectangular thick plate which generally covers the upper surface opening of the male housing 35.

Figure 9:
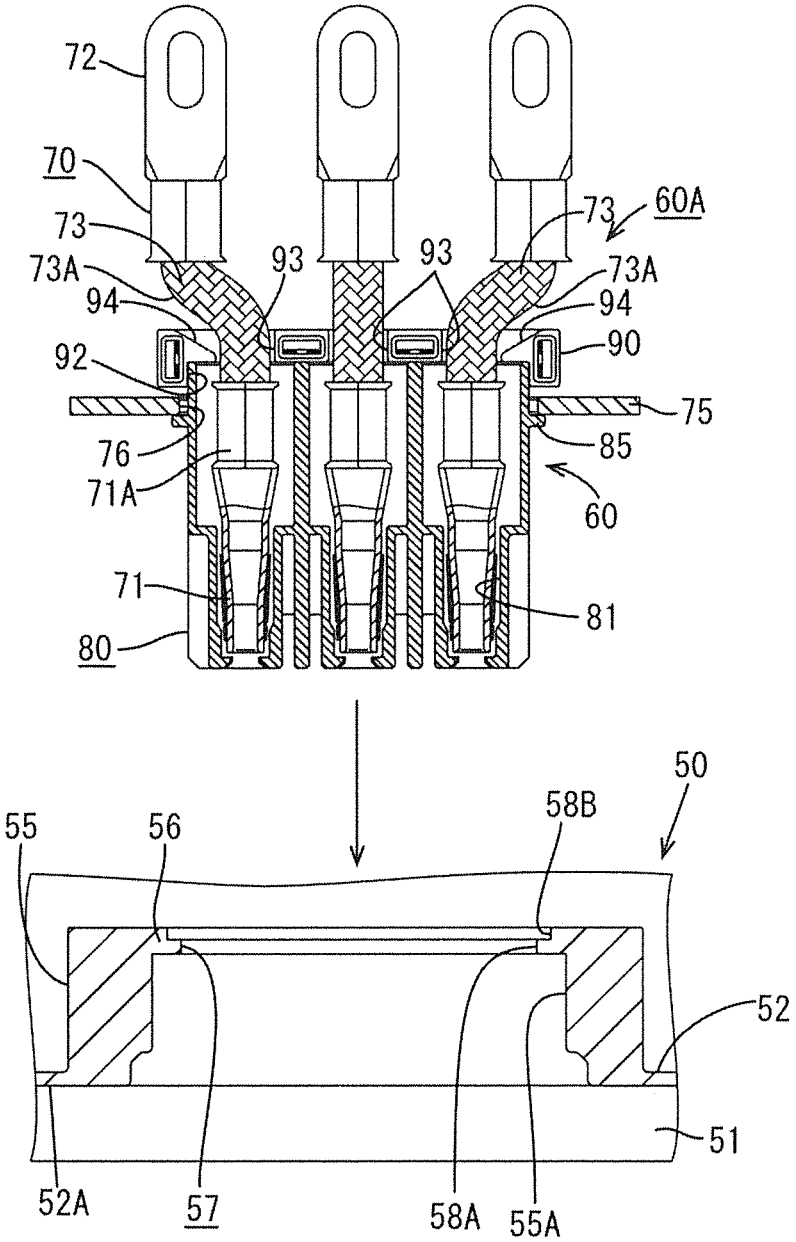
FIG. 9 is a partial cross sectional view illustrating an operation for attaching the inverter-side connector.

As illustrated in FIG. 9, on a lower surface of the integrated guide member 90, an oval fitting recess portion 92 having a predetermined depth is formed, in which the upper end portion of the female housing 80 can be tightly fitted. In a roof surface of the fitting recess portion 92, three insertion holes 93 are formed at the same pitch as the cavities 81 and concentrically with the cavities 81. In the insertion holes 93, connecting ends of the braided wires 73 for the female terminals 71 can be inserted. Of the three insertion holes 93, in the insertion holes 93 on the right and left ends, the respective outer surfaces in their arranged direction (the left-side surface of the left-end insertion hole 93, and the right side surface of the right-end insertion hole 93) include tapered surfaces 94 opening diagonally upward.

As illustrated in FIG. 2, of the divided guide members 91A, 91B, one divided guide member 91A is formed with a total of four lock pieces 95 in a protruding manner at both ends of the divided guide member 91A in the longitudinal direction and between the insertion holes 93. On the other divided guide member 91B, four lock receiver portions 96 are formed at corresponding positions to receive and retain the respective lock pieces 95.

On a linear wall surface of the fitting recess portion 92 of each of the divided guide members 91A, 91B, a pair of attachment protrusions 97 is formed in a protruding manner. In linear front and rear surfaces of the upper end portion of the female housing 80, a pair of attachment recess portions 83 is bored for fitting the attachment protrusions 97.

When the inverter-side connector 60 is assembled, the female terminals 71 of the inverter-side terminals 70 are inserted into the corresponding cavities 81 of the female housing 80 from above, and primarily locked by a lance 82 provided in the cavities 81 (see FIG. 8). Then, the pair of divided guide members 91A, 91B is disposed so as to sandwich the upper end portion of the female housing 80 from the front and rear. The attachment protrusions 97 are fitted in the attachment recess portions 83, and the opposing edges are abutted on each other while the lock pieces 95 are inserted into the lock receiver portions 96. When the opposing edges are normally abutted on each other, the lock pieces 95 are elastically locked in the lock receiver portions 96, whereby the guide member 90 is integrally assembled. In addition, the guide member 90 is attached with the upper end portion of the female housing 80 fitted in the fitting recess portion 92. When the guide member 90 is attached, barrels 71A on the upper ends of the female terminals 71 are locked on hole edges on the lower side of the respective insertion holes 93, whereby dual retention is achieved.

The braided wires 73 connected to the barrels 71A of the female terminals 71 are led out upward through the insertion holes 93 of the guide member 90. In the present embodiment, as illustrated in FIG. 5 and FIG. 6, with respect to the three inverter-side terminals 70, the BA terminals 72 are disposed at a greater pitch than that of the female terminals 71. Accordingly, as illustrated in FIG. 9, the two inverter-side terminals 70 on the right and left ends are formed such that the respective braided wires 73 are bent toward left or right at exit portions of the insertion holes 93 of the guide member 90 (bent portion 73A), and then extend upward at eccentric positions. In this case, because the insertion holes 93 on both ends of the guide member 90 are formed with the tapered surfaces 94, the braided wires 73 can be bent as described above without interference with the inner surfaces of the insertion holes 93.

The motor-side connector 30 is fixedly attached to the motor case 10. On the other hand, the inverter-side connector 60 is adapted to be attached to the inverter case 50 in a floating state.

As schematically illustrated in FIG. 5, the inverter case 50 has a body case 51, on front surface side of which a connector attachment case 52 for attachment of the inverter-side connector 60 (hereafter "attachment case 52") is formed extending with a bottom raised by a predetermined size. Accordingly, the inverter-side connector 60 is attached to the attachment case 52 in a floating state.

A structure for attaching the inverter-side connector 60 in a floating state will be described with reference to FIG. 6 and FIG. 9. The female housing 80 of the inverter-side connector 60 has a flange 85 at a position closer to the upper end, the flange 85 extending along the entire circumference.

On a bottom surface 52A of the attachment case 52, a mount base 55 with a lower surface opening is formed upright. The mount base 55 has a substantially parallelogrammatic planar shape. The interior of the mount base 55 provides the fitting recess portion 55A for fitting the upper end portion of the male housing 35 of the motor-side connector 30.

A roof wall 56 of the mount base 55 has a support hole 57 in which the female housing 80 is inserted from above and supported is opened. As illustrated in FIG. 9, the support hole 57 is a stepped hole including a small-diameter hole 58A on the lower side in which the outer periphery of the female housing 80 can be fitted with a clearance, and a large-diameter hole 58B on the upper side in which the flange 85 of the female housing 80 can be fitted with a clearance. The large-diameter hole 58B on the upper side has a depth slightly smaller than a thickness of the flange 85.

The right and left side walls of the respective mount bases 55 are thickly formed.

The mount base 55 is adapted to mount a bracket 75 of metal plate. The bracket 75 has a planar shape substantially identical to the upper surface of the mount base 55. As illustrated in FIG. 9, the bracket 75 has a lock hole 76 in which the outer periphery of the female housing 80 can be fitted with a clearance.

The bracket 75 is sandwiched between the flange 85 and the guide member 90 with the hole edge on the lower side of the lock hole 76 being adapted to be locked on the peripheral edge of the flange 85 formed on the outer periphery of the female housing 80, and with the hole edge on the upper side of the lock hole 76 being adapted to be locked on the guide member 90 attached to the rear end of the female housing 80.

Figure 4:
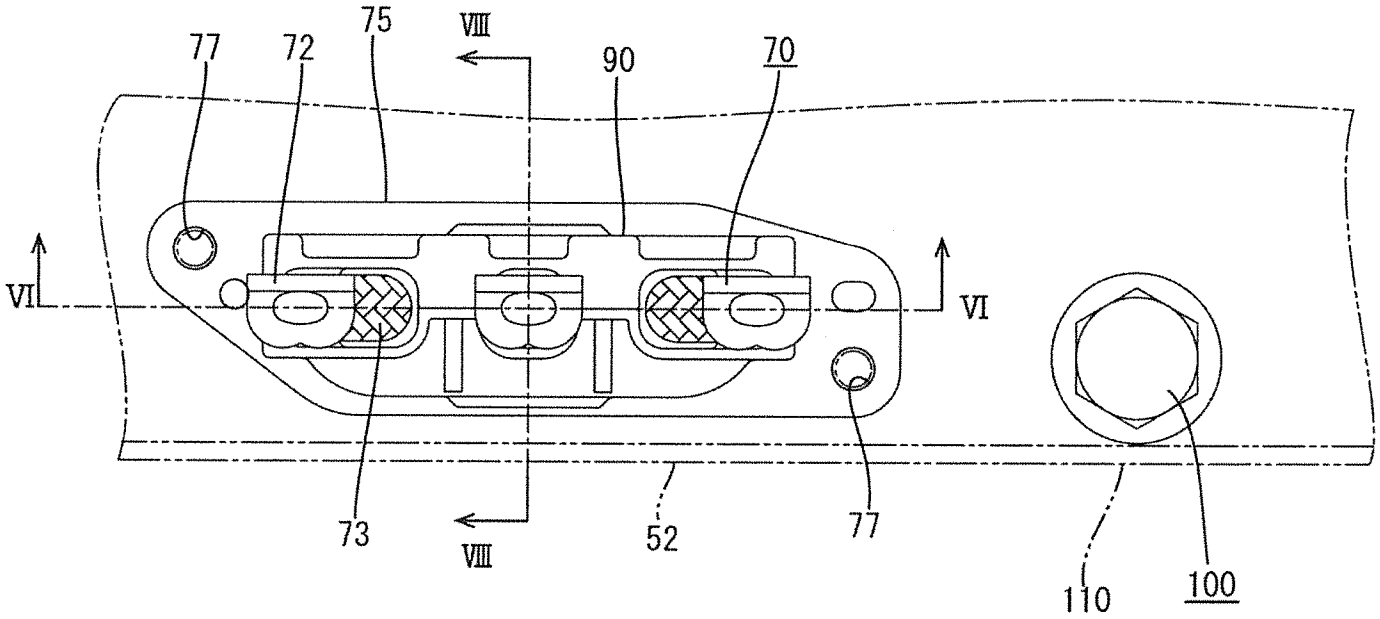
FIG. 4 is a plan view illustrating an inverter-side connector attachment structure.

As illustrated in FIG. 4, screw insertion holes 77 are opened in both ends of the bracket 75. The bracket 75 is adapted to be fixed to the upper surface of the mount base 55 by passing screws 78 (see FIG. 10) through the screw insertion holes 77 and fastening the screws by threaded engagement in screw holes (not illustrated) formed in the right and left side walls of the mount base 55, with the lock hole 76 disposed concentrically with respect to the support hole 57.

The inverter-side connector 60 is attached to the inverter case 50 (attachment case 52) in a floating state through a following procedure, for example.

As illustrated in FIG. 9, the bracket 75 is fitted on the upper end portion of the female housing 80 and received on the flange 85 in advance. Then, the inverter-side connector 60 including the guide member 90 is assembled as described above, making a sub-assembly 60A. The sub-assembly 60A is delivered to a site for attachment. In the sub-assembly 60A, the guide member 90 is already attached to the rear end of the female housing 80, with the bracket 75 sandwiched between the flange 85 and the guide member 90. Accordingly, the bracket 75 is prevented from falling off from the female housing 80 during delivery.

As indicated by an arrow in FIG. 9, at the site for attachment, the female housing 80 of the sub-assembly 60A is inserted into the support hole 57 of the mount base 55 from above. Then, as illustrated in FIG. 10, the flange 85 is received and supported on the hole edge of the small-diameter hole 58A of the support hole 57. At the same time, the bracket 75 is stacked on the upper surface of the mount base 55 and fixed with the screws 78, with the upper end portion of the female housing 80 inserted through the lock hole 76. Accordingly, the flange 85 is locked on the hole edge of the lock hole 76, and the retained female housing 80 is prevented from falling off upward.

In this way, the female housing 80, with the upper end portion thereof penetrating through the support hole 57 of the mount base 55 and the lock hole 76 of the bracket 75, is supported so as to be radially freely movable by an amount corresponding to the clearance mainly between the flange 85 and the large-diameter hole 58B. That is, the female housing 80 is attached in a floating state with respect to the attachment case 52. The support hole 57 of the mount base 55 provided on the attachment case 52, and the lock hole 76 of the bracket 75 fixed on the mount base 55 constitute a mounting hole 79. In the mounting hole 79, the inverter-side connector 60 penetrates through in a radially freely movable manner and is supported.

In the present embodiment, as partly described above, the motor-side connector 30 and the inverter-side connector 60 are adapted to be fitted to each other when the inverter case 50 is mounted on the motor case 10 and coupled therewith. The relevant structure will be described below.

As illustrated in FIG. 4, laterally of the mount base 55 on the bottom surface of the attachment case 52, a pedestal 110 for supporting the fastening bolt 100 in a hanging and axially rotatable manner is formed. The pedestal 110 is formed upright to a height position corresponding to substantially the center of the mount base 55, with an open lower surface. The lower end of a male screw portion of the fastening bolt 100 supported on the pedestal 110 in a hanging manner protrudes from the bottom surface 52A of the attachment case 52 by a predetermined size, so that the fastening bolt 100 can be threadedly engaged in the screw hole 25 in the female screw base 24 provided in the shield shell 20 fixed to the upper surface of the motor case 10.

When the inverter case 50 is mounted on the motor case 10, a positioning mechanism, not illustrated, is provided to ensure mounting at a predetermined position. The positioning mechanism is set such that, when the inverter case 50 is normally positioned opposite the motor case 10, the inverter-side connector 60 and the motor-side connector 30 are coaxially opposed to each other, and the fastening bolt 100 and the screw hole 25 of the female screw base 24 are coaxially opposed to each other.

The bottom surface of the body case 51 of the inverter case 50 and the upper surface of the motor case 10 are adapted to be fastened together at a plurality of locations using auxiliary bolts, which are not illustrated.

The operation of the present embodiment having the above-described structure will be described.

As illustrated in FIG. 3 and FIG. 6, on the motor side, the motor-side connector 30 is retained in each holding hole 21 of the shield shell 20 so as to be water-tightly fitted via the second axial seal 44. The shield shell 20 is placed on the motor case 10 with the lower end portion of each male housing 35 fitted in the corresponding mounting hole 11 opened in the upper surface of the motor case 10. The shield shell 20 is then fixed by passing the bolts 27 through the bolt insertion holes 26 opened in the shield shell 20, and screwing the bolts into screw holes in the motor case 10. In this way, the motor-side connector 30 is fixedly attached to the upper surface of the motor case 10.

When the shield shell 20 is fixed, the step portion 21C of the holding hole 21 presses the lower flange 42 of the male housing 35. The surface seal 45 disposed on the lower surface of the male housing 35 is pressed onto the outer periphery of the upper hole edge of the mounting hole 11 in an elastically compressed manner for sealing.

On the other hand, on the inverter side, the inverter-side connector 60 is supported while penetrating through the mounting hole 79 of the mount base 55 provided on the attachment case 52 of the inverter case 50, in a radially freely movable manner. That is, the inverter-side connector 60 is attached in a floating state. In this case, with respect to the three inverter-side terminals 70, the braided wires 73 of the inverter-side terminals 70 on the right and left sides are bent outward, so that the pitch of the BA terminals 72 is extended.

In addition, the fastening bolt 100 is hung and supported rotatably with respect to the pedestal 110.

The inverter-side connector 60 is fitted to the corresponding motor-side connector 30 as follows.

From the state illustrated in FIG. 6, the inverter case 50 is positioned by the positioning mechanism and lowered onto the motor case 10 whereby, as illustrated in FIG. 10, the inverter-side connector 60 begins to be fitted to the motor-side connector 30. Even if the inverter-side connector 60 and the motor-side connector 30 are misaligned, the inverter-side connector 60, being supported in a floating state, can freely move radially and be aligned, whereby the connectors 30, 60 can be normally and smoothly fitted together.

Figure 11:
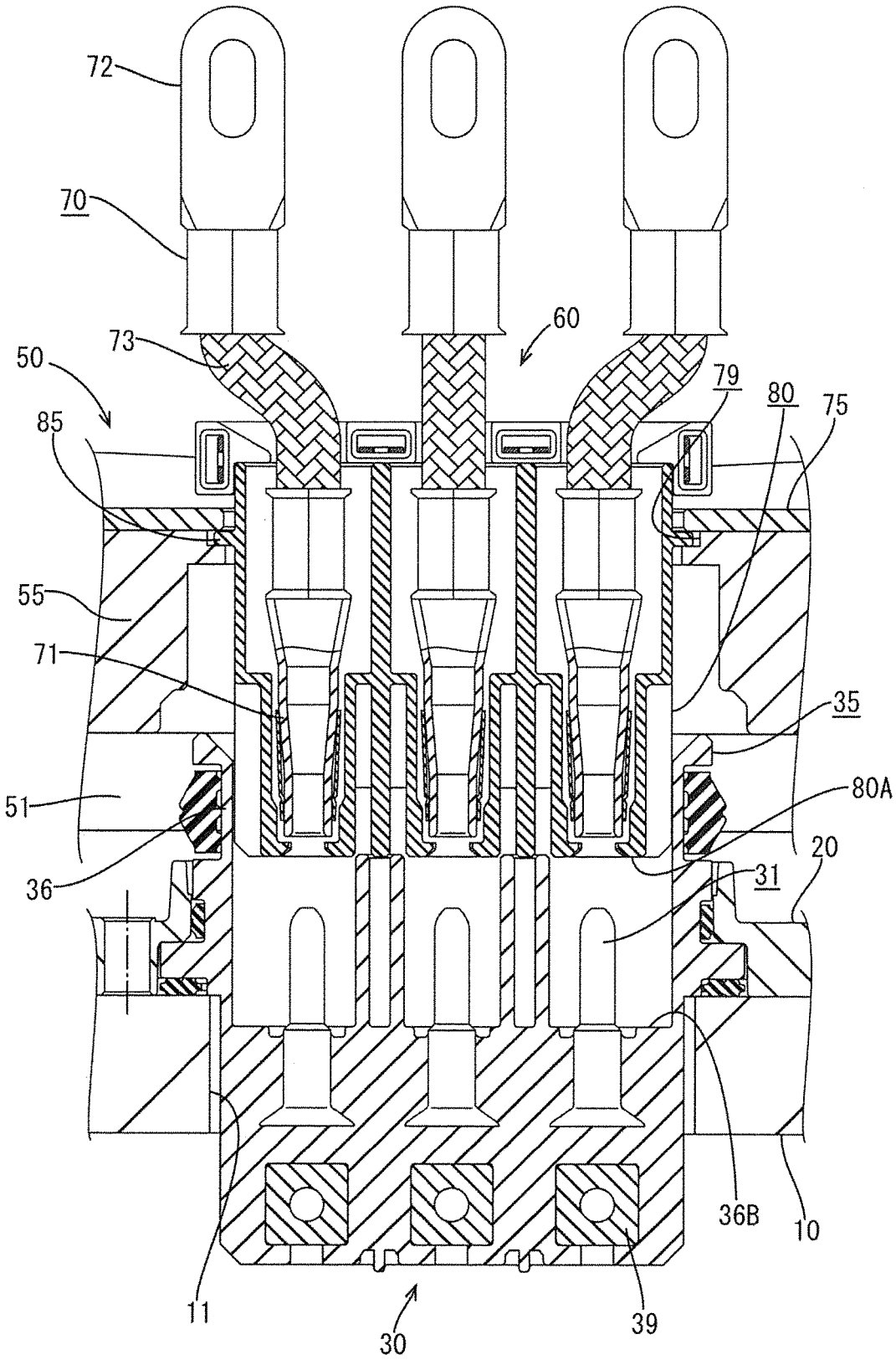
FIG. 11 is a partial cross sectional view illustrating an initial state of fitting.
Figure 12:
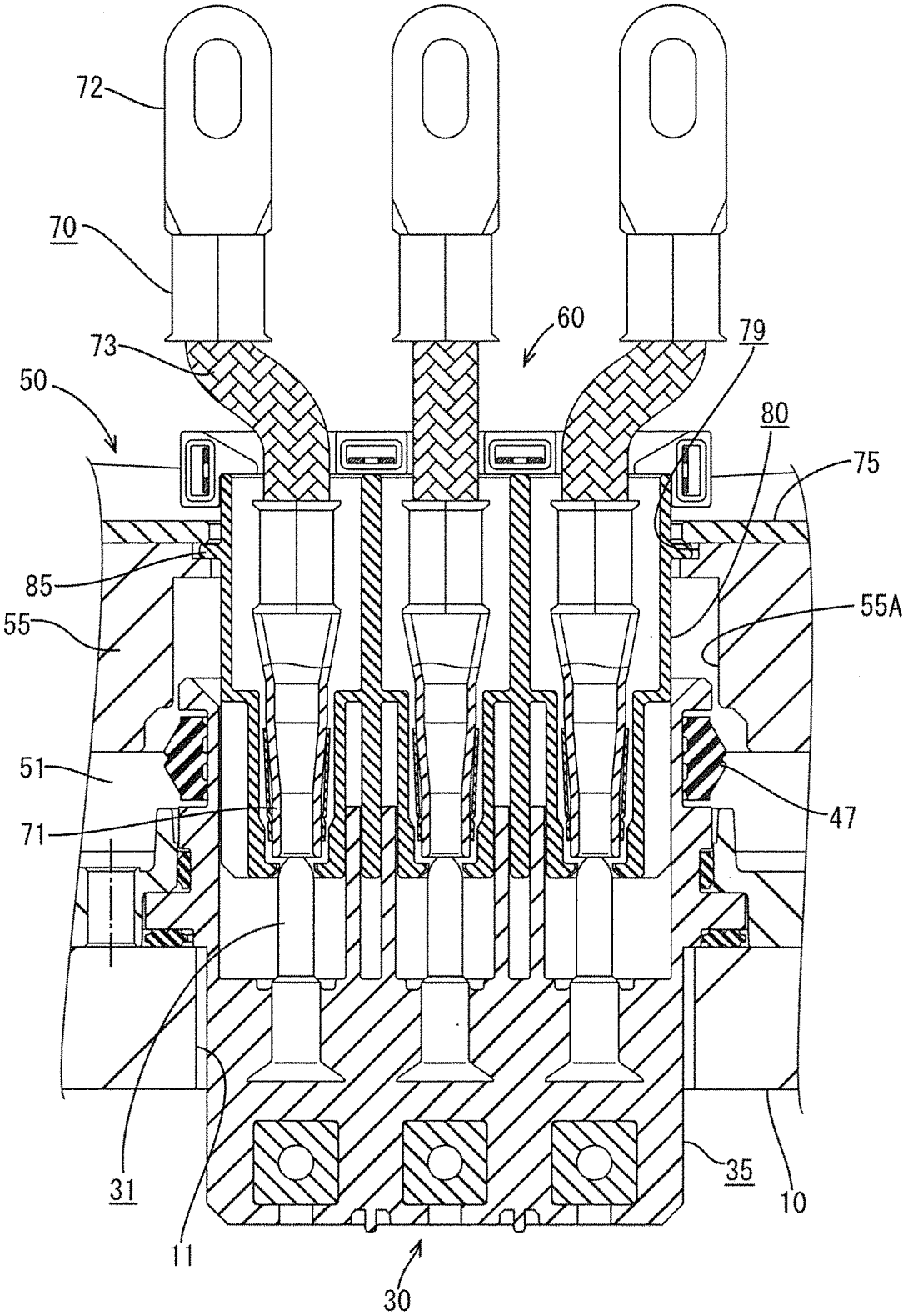
FIG. 12 is a partial cross sectional view illustrating a middle state of fitting.

When the inverter-side connector 60 has been fitted to the opposing motor-side connector 30 by a predetermined amount, as illustrated in FIG. 11, the end of the male screw portion of the fastening bolt 100 faces the entry of the screw hole 25 threaded in the female screw base 24 of the shield shell 20.

Thereafter, the fastening bolt 100 is screwed into the screw hole 25 using a tool, such as a torque wrench. This produces a boosting function whereby, as illustrated in FIG.

12, the inverter case 50 including the attachment case 52 is pulled toward the upper surface of the motor case 10, and the inverter-side connector 60 is further fitted to the motor-side connector 30 gradually.

Figure 13:
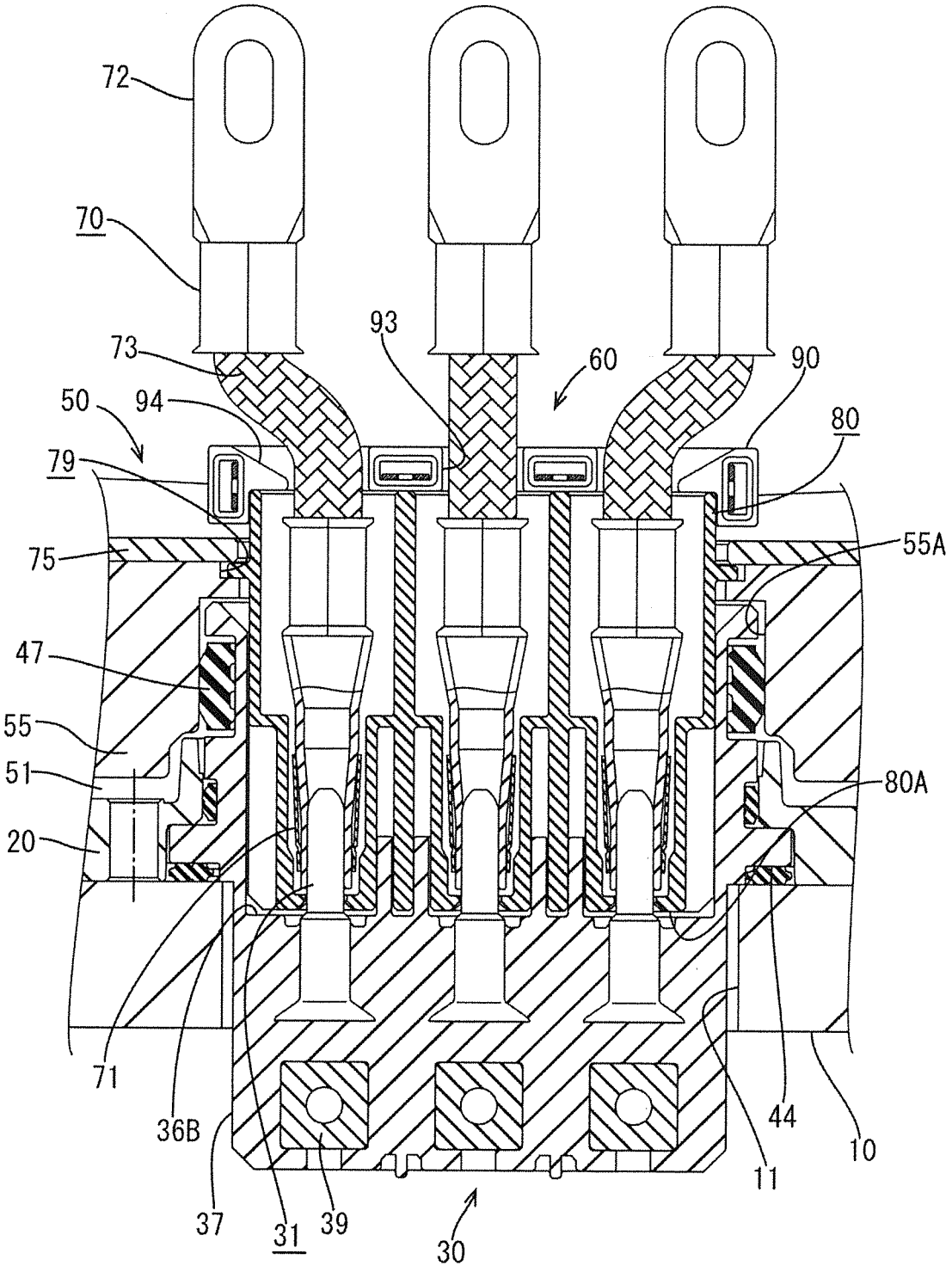
FIG. 13 is partial cross sectional view illustrating a completed state of fitting.

As illustrated in FIG. 13, when the body case 51 of the inverter case 50 has abutted on the upper surface of the motor case 10, the fastening of the fastening bolt 100 is stopped. Then, the body case 51 is fixed in the state of being abutted on the upper surface of the motor case 10, using the auxiliary bolt.

This results in the inverter-side connector 60 and the motor-side connector 30 being normally fitted to each other. In addition, the state in which the first axial seal 47 fitted on the male housing 35 of the motor-side connector 30 is in close contact with the inner periphery of the fitting recess portion 55A of the mount base 55 to seal the same is also maintained.

In this way, when the inverter case 50 is mounted on the motor case 10 and coupled therewith, the operation for fitting the motor-side connector 30 with the inverter-side connector 60 is completed.

In the motor case 10, at the terminal base 37 of the motor-side connector 30, motor input terminals are placed on the connecting plate portions 32 of the motor-side terminals 31 and connected by bolting. On the other hand, in the inverter case 50, the BA terminals 72 of the inverter-side terminals 70 are connected to inverter output terminals with screws using a terminal base, which is not illustrated.

The inverter-side connector 60 according to the present embodiment provides the following effects.

When the inverter-side terminal 70 is attached to the female housing 80, the outer periphery of the braided wires 73 on the connecting end side with respect to the female terminals 71 is fitted and held in the insertion holes 93 of the guide member 90. Accordingly, unnecessary tilting or deformation, for example, of the braided wires 73 as a whole is reduced or prevented. In addition, displacement of the BA terminals 72 of the inverter-side terminal 70 is reduced or prevented. As a result, the BA terminals 72 are disposed at matching positions with the terminal base provided at a predetermined position in the inverter case 50. Accordingly, the operation for connecting the BA terminals 72 with the inverter output terminals at the terminal base using screws can be efficiently performed.

In the present embodiment, as illustrated in FIG. 9, for example, with respect to the three inverter-side terminals 70, the BA terminals 72 are disposed at a greater pitch than that of the female terminals 71. Accordingly, with respect to the two inverter-side terminals 70 on the right and left ends, the braided wires 73 are bent toward right or left at the exit portions of the insertion holes 93 of the guide member 90 and then formed to extend upward at eccentric positions. In this case, because the insertion holes 93 on both ends are formed with the tapered surfaces 94, the braided wires 73 can be bent as described above without interference with the inner surfaces of the insertion holes 93.

In the present embodiment, the inverter-side connector 60 is attached to the inverter case 50 (attachment case 52) in a floating state through the following procedure. As illustrated in FIG. 9, from the state in which bracket 75 is fitted on the upper end portion of the female housing 80 in advance, the inverter-side connector 60 is assembled to form the sub-assembly 60A. The sub-assembly 60A is delivered to the site for attachment, where, as indicated by the arrow in the drawing, the sub-assembly 60A is inserted into the support hole 57 of the mount base 55 and supported thereon. Thereafter, the bracket 75 is fixed on the mount base 55.

Because the guide member 90 is attached to the rear end of the female housing 80, the bracket 75 is prevented from falling off during delivery of the sub-assembly 60A.

The guide member 90 is adapted to be formed by assembling a pair of divided guide members 91A, 91B. Accordingly, the guide member 90 can be integrated subsequently without being passed through the inverter-side terminal 70 in advance. Accordingly, the assembly operation for the inverter-side connector 60 is simplified.

The present invention is not limited to the embodiment explained in the above description and described with reference to the drawings. The present invention may include the following embodiments in the technical scope of the invention.

While in the embodiment the number of the terminal metal fittings attached to the housing is three, the number may be any number, including one.

The flexible conductive member provided in the terminal metal fittings is not limited to the braided wires of the embodiment, and may include other members, such as bare stranded wires.

The present invention is not limited to the embodiment in which the housings are fitted together when the cases are stacked one above the other and coupled with each other. For example, the present invention may also be applied to a case where a counterpart housing is initially fitted to the housing of a case, and then the counterpart housing is fitted to the counterpart case.

In the embodiment, the inverter-side connector has been described as an exemplary device connector. However, the present invention may be widely applied to general device connectors attached to the case of electronic devices other than an inverter.

EXPLANATION OF SYMBOLS

50: Inverter case (case)
52: Attachment case
55: Mounting base
56: Roof wall (wall portion)
57: Support hole (stepped hole)
60: Inverter-side connector (device connector)
60A: Sub-assembly
70: Inverter-side terminal (terminal metal fitting)
71: Female terminal (first connecting portion)
72: BA terminal (second connecting portion)
73: Braided wire (flexible conductive member)
75: Bracket (lock plate)
76: Lock hole
79: Mounting hole
80: Female housing (housing)
81: Cavity
85: Flange
90: Guide member
91A, 91B: Divided guide member
93: Insertion hole
94: Tapered surface (relief surface)

The invention claimed is:

1. A device connector comprising:

a terminal metal fitting including a first connecting portion, a second connecting portion, and a flexible conductive member linking the first connecting portion and the second connecting portion;

a housing having a cavity for accommodating the first connecting portion; and a guide member attached to a rear surface of the housing, and having an insertion hole opened concentrically with the cavity, the insertion hole corresponding to a connecting end of the flexible conductive member of the terminal metal fitting, the connecting end being to be connected to the first connecting portion, wherein:

the first connecting portion includes a barrel connected to the flexible conductive member, and is configured to be primarily locked by a lance provided in the cavity and doubly retained by the barrel being locked on a hole edge of the insertion hole; and the flexible conductive member has a connecting end to be connected to the second connecting portion extending outside the guide member through the insertion hole.

2. The device connector according to claim 1, wherein the guide member is formed by assembling a pair of divided guide members.

3. A device connector comprising:

a terminal metal fitting including a first connecting portion, a second connecting portion, and a flexible conductive member linking the first connecting portion and the second connecting portions;

a housing having a cavity for accommodating the first connecting portion; and a guide member attached to a rear surface of the housing, and having an insertion hole opened concentrically with the cavity, the insertion hole corresponding to a connecting end of the flexible conductive member of the terminal metal fitting, the connecting end being to be connected to the first connecting portion, wherein:

the flexible conductive member has a connecting end to be connected to the second connecting portion extending outside the guide member through the insertion hole;

the housing has a plurality of terminal metal fittings attached thereto side by side; and the insertion hole of the guide member is formed with a relief surface for avoiding interference with an eccentrically bent portion of the flexible conductive member extending through the insertion hole.

4. The device connector according to claim 3, wherein the guide member is formed by assembling a pair of divided guide members.

5. A device connector comprising:

a terminal metal fitting including a first connecting portion, a second connecting portion, and a flexible conductive member linking the first connecting portion and the second connecting portion;

a housing having a cavity for accommodating the first connecting portion; and a guide member attached to a rear surface of the housing, and having an insertion hole opened concentrically with the cavity, the insertion hole corresponding to a connecting end of the flexible conductive member of the terminal metal fitting, the connecting end being to be connected to the first connecting portion, wherein the flexible conductive member has a connecting end to be connected to the second connecting portion extending outside the guide member through the insertion hole, the device connector comprising a lock plate for attaching the housing to a device for attachment, the lock plate having a lock hole opened so as to be lockable on a peripheral edge of a flange circumferentially disposed on an outer surface of the housing, wherein the device connector is configured as a sub-assembly with the lock plate retained between the flange and the guide member attached on the rear surface of the housing.

6. The device connector according to claim 5, wherein the guide member is formed by assembling a pair of divided guide members.

7. A device connector comprising:

a terminal metal fitting including a first connecting portion, a second connecting portion, and a flexible conductive member linking the first connecting portion and the second connecting portion;

a housing having a cavity for accommodating the first connecting portion; and a guide member attached to a rear surface of the housing, and having an insertion hole opened concentrically with the cavity, the insertion hole corresponding to a connecting end of the flexible conductive member of the terminal metal fitting, the connecting end being to be connected to the first connecting portion, wherein:

the first connecting portion includes a barrel connected to the flexible conductive member, and is configured to be primarily locked by a lance provided in the cavity and doubly retained by the barrel being locked on a hole edge of the insertion hole;

the flexible conductive member has a connecting end to be connected to the second connecting portion extending outside the guide member through the insertion hole;

the housing has a plurality of terminal metal fittings attached thereto side by side; and the insertion hole of the guide member is formed with a relief surface for avoiding interference with an eccentrically bent portion of the flexible conductive member extending through the insertion hole, the device connector comprising a lock plate for attaching the housing to a device for attachment, the lock plate having a lock hole opened so as to be lockable on a peripheral edge of a flange circumferentially disposed on an outer surface of the housing, wherein:

the device connector is configured as a sub-assembly with the lock plate retained between the flange and the guide member attached on the rear surface of the housing; and the guide member is formed by assembling a pair of divided guide members.

* * * * *